US005809958A

United States Patent [19]

Gracyalny

[11] Patent Number: 5,809,958

[45] Date of Patent: Sep. 22, 1998

[54] COMPRESSION RELEASE FOR MULTI-CYLINDER ENGINES

[75] Inventor: Gary J. Gracyalny, Milwaukee, Wis.

[73] Assignee: Briggs & Stratton Corporation, Wauwatosa, Wis.

[21] Appl. No.: 853,386

[22] Filed: May 8, 1997

Related U.S. Application Data

[60] Provisional application No. 60/035,573, Jan. 14, 1997.

[51] Int. Cl. [6] ..... F01L 13/08

[52] U.S. Cl. ..... 123/182.1

[58] Field of Search ..... 123/182.1

[56] References Cited

U.S. PATENT DOCUMENTS

| | | | |
|---|---|---|---|
| 1,439,798 | 12/1922 | Crane | 123/182.1 |
| 1,990,427 | 2/1935 | Dawson | 123/182.1 |
| 2,054,928 | 9/1936 | Church | 123/182.1 |
| 2,086,609 | 7/1937 | Edwards | 123/182.1 |
| 2,947,300 | 8/1960 | Trapp | 123/182.1 |
| 3,381,676 | 5/1968 | Campen | 123/182.1 |
| 3,511,219 | 5/1970 | Esty | 123/182.1 |
| 4,590,905 | 5/1986 | Matsuki et al. | 123/182.1 |
| 4,615,313 | 10/1986 | Tsumiyama | 123/182.1 |
| 4,898,133 | 2/1990 | Bader | 123/182.1 |
| 5,197,422 | 3/1993 | Oleksy et al. | 123/182.1 |
| 5,301,643 | 4/1994 | Garcyalny | 123/198 D |
| 5,317,999 | 6/1994 | Kern et al. | 123/182.1 |

FOREIGN PATENT DOCUMENTS

| | | | |
|---|---|---|---|
| 896700 | 2/1945 | France . | |
| 2-67409 | 3/1990 | Japan | 123/182.1 |
| 107515 | 5/1991 | Japan | 123/182.1 |
| 607750 | 9/1948 | United Kingdom . | |

OTHER PUBLICATIONS

Photo of a Compression Release Device first sold by Briggs & Stratton Corporation about Mar., 1988.

*Primary Examiner*—Andrew M. Dolinar
*Attorney, Agent, or Firm*—Michael Best & Friedrich LLP

[57] ABSTRACT

A centrifugally-responsive compression release apparatus relieves compression in more than one cylinder of an internal combustion engine during starting. The compression release apparatus utilizes a centrifugally-responsive flyweight, a single shaft operable by the flyweight, and one or more lift members movable by the shaft and engageable with one or more valve operating devices. The compression release apparatus may employ a single lift member that is engageable with two valve operating devices upon rotation of the shaft, or alternatively, a pair of lift members each engageable with a distinct valve operating device. Thus, the compression release apparatus is particularly adaptable to reducing compression in two cylinders of a V-twin engine, but may be adapted to reducing compression in an engine having more than two cylinders.

15 Claims, 8 Drawing Sheets

FIG. 1
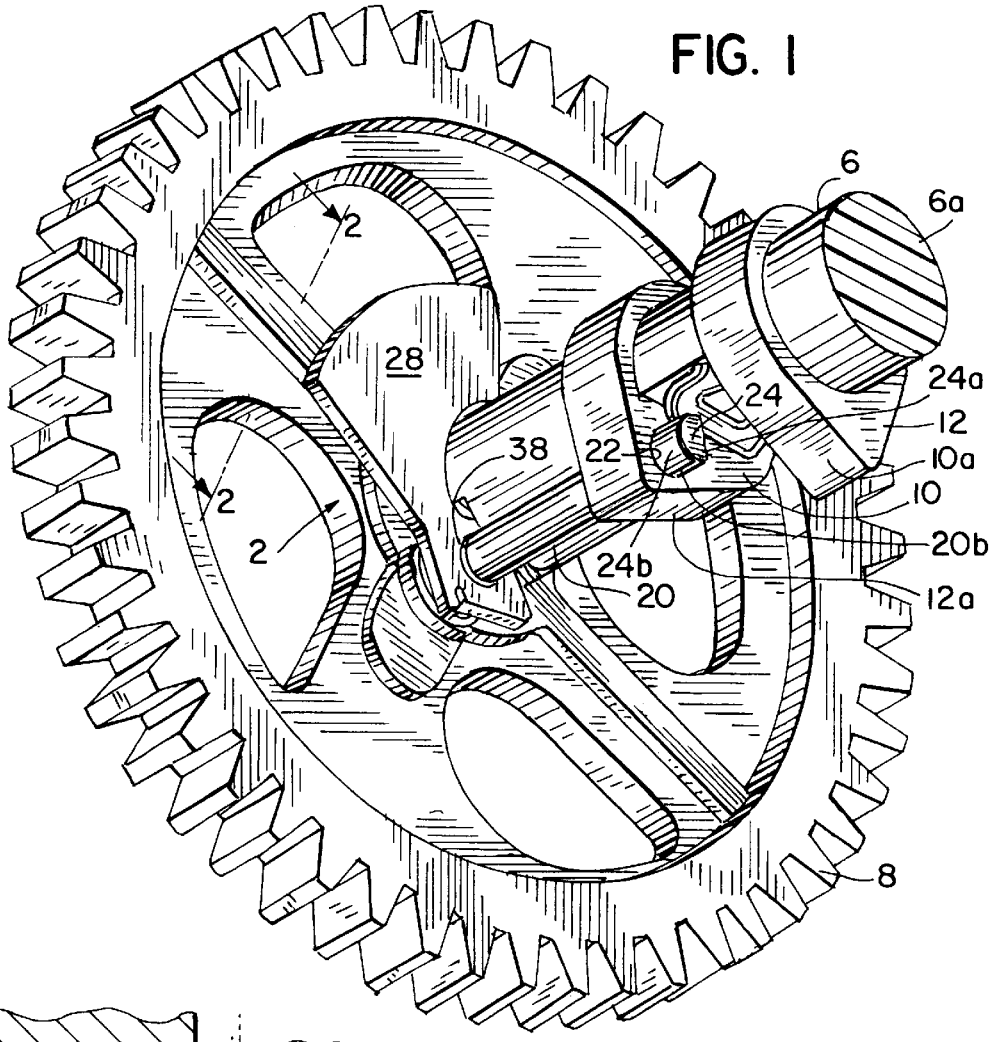
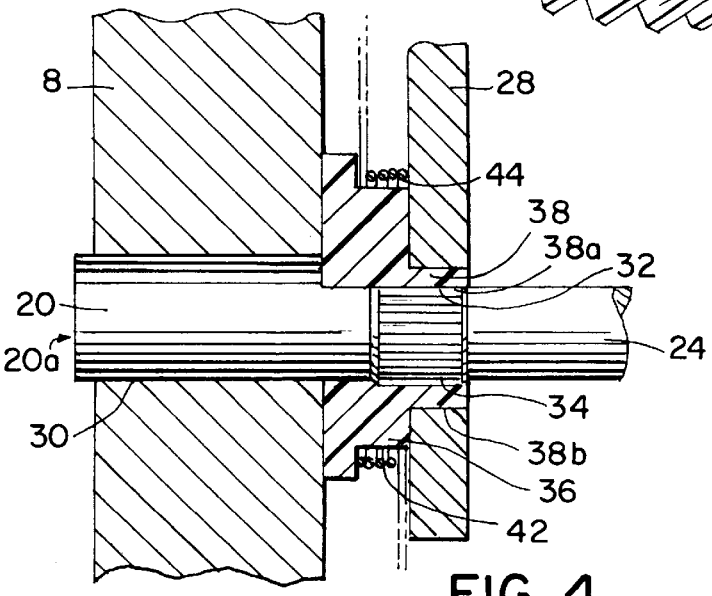
FIG. 4
FIG. 5
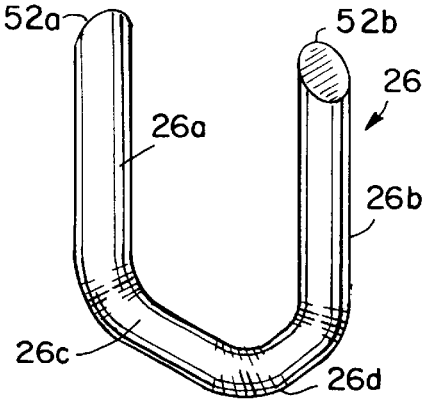

FIG. 6
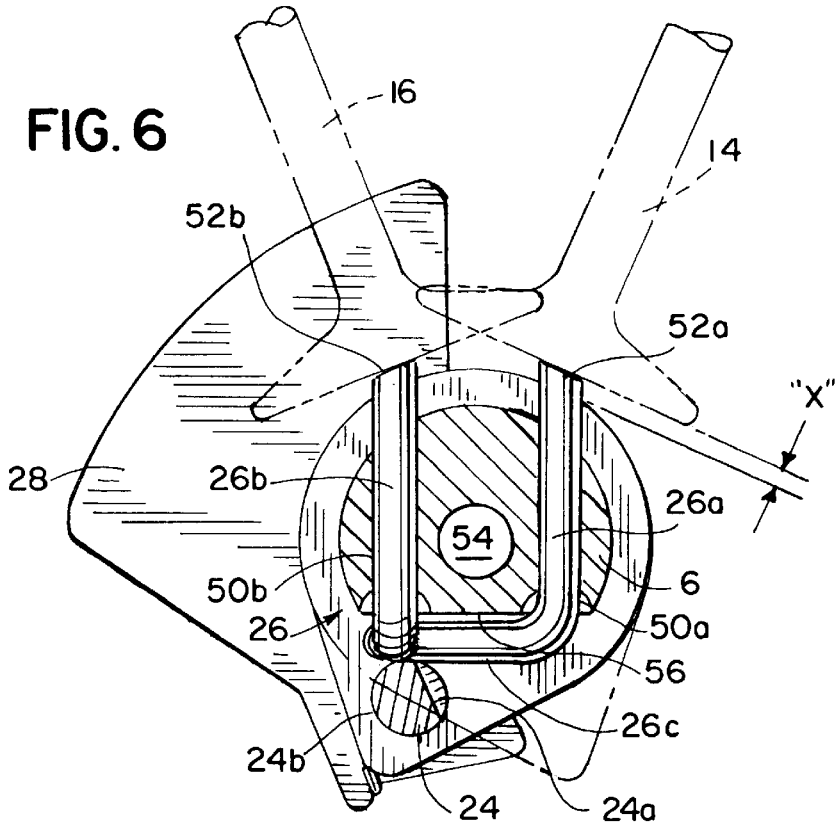
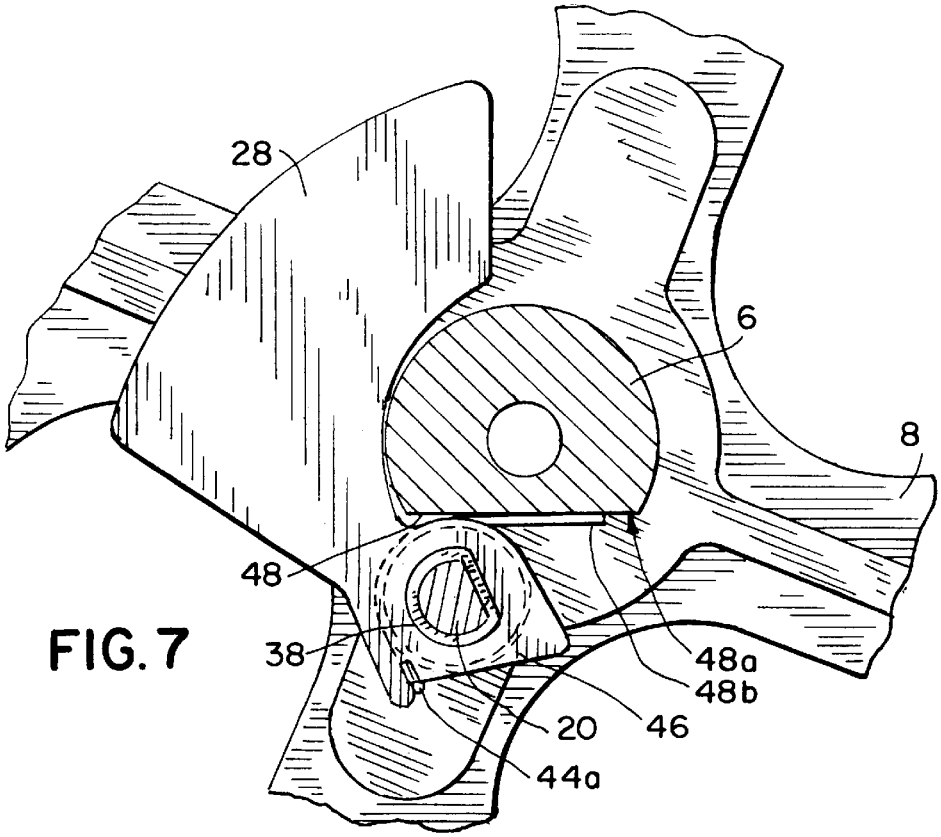
FIG. 7

FIG. 13
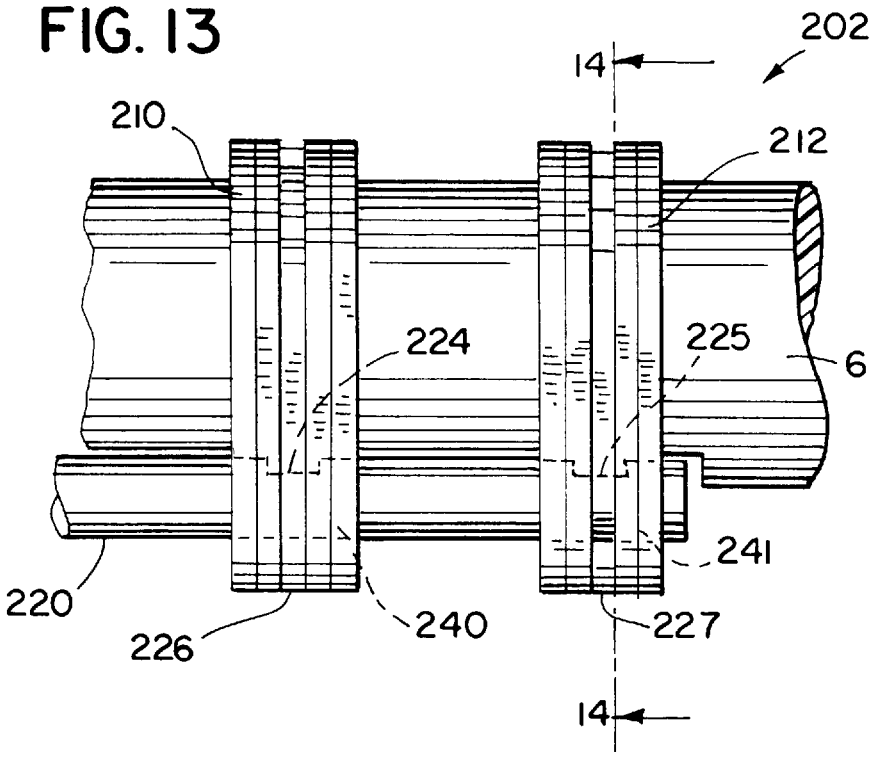
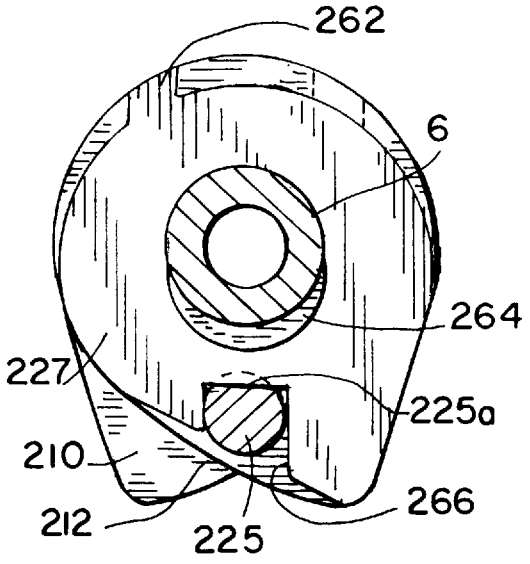
FIG. 14
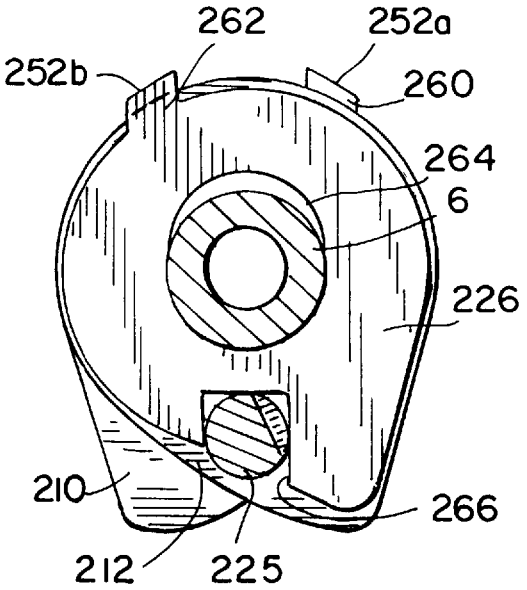
FIG. 15

COMPRESSION RELEASE FOR MULTI-CYLINDER ENGINES

This application claims benefit of Provisional Patent Application Ser. No. 60/035,573, filed Jan. 14, 1997.

FIELD OF THE INVENTION

The present invention relates generally to internal combustion engines, and more particularly to a compression release apparatus for reducing compression in more than one cylinder of the internal combustion engine during starting.

BACKGROUND OF THE INVENTION

It is known to use a D-shaped shaft in combination with a flyweight to lift a valve tappet on a valve operating system to thereby partially relieve compression in a combustion chamber during engine starting. U.S. Pat. No. 5,197,422 to Oleksy is one example. However, the Oleksy device cannot be used to reduce the compression in more than one cylinder.

SUMMARY OF THE INVENTION

The present invention is directed to a centrifugally-responsive compression release apparatus for reducing compression in a plurality of combustion chambers in an engine having a cam shaft. The compression release apparatus is particularly adapted to reducing compression in the two cylinders of a V-twin engine, but may be adapted to relieve compression in more than two cylinders of an engine.

The compression release apparatus may utilize a single lift member that is engageable with two valve operating devices and centrifugally-responsive means (e.g., a flyweight) for changing the position of the lift member in response to engine speeds. The two valve operating devices may be disposed at two distinct angular positions relative to a longitudinal axis of the cam shaft. Further, the apparatus may utilize a single shaft that is engageable with the lift member and is operable by the centrifugally-responsive means. In one embodiment, the centrifugally-responsive means includes a single flyweight and the single shaft is integrally formed as one piece with the flyweight.

Alternatively, the compression release apparatus may employ a single shaft and a plurality of lift members that are each engageable with a distinct valve operating device. The single shaft is engageable with the plurality of lift members and is positioned substantially outside of the cam shaft.

In several embodiments of the present invention, the compression release apparatus employs a lift member that is disposed substantially around, or substantially adjacent to, an outer surface of the cam shaft. In some embodiments, the cam shaft has a guideway and the lift member is at least partially received in the guideway. In further embodiments, an elongated portion of the lift member is at least partially received within the guideway.

In one particular embodiment of the present invention, a single shaft is engageable with a single lift member at a D-shaped portion of the single shaft. The lift member has two prongs with bearing surfaces that engage the bottom surfaces of valve tappets. The lift member is preferably U-shaped and may be disposed in guideways (e.g., slots, gaps, or apertures) through the cam shaft, or may be disposed around the cam shaft. At engine starting speed, the single shaft positions the lift member such that the two prongs are engageable with the valve tappets to lift the respective exhaust valves off their seats during a particular period in the compression stage of the engine cycle. As engine speed is increased, the flyweight moves away from the cam shaft, thereby rotating the shaft attached thereto so that a flat side of the D-shaped shaft portion is adjacent to the lift member. As a result, the lift member is pushed away by the valve tappets during crankshaft rotation, and thus does not affect the seating of the valves at engine operating speeds.

In an alternative embodiment of the invention, wherein the engine has at least one cam lobe that is formed from at least two laminations mounted on the cam shaft, the apparatus utilizes at least one lift member that is formed from one of the at least two laminations. A single shaft is engageable with the lift member and the lift member is movable relative to the other lamination(s) to engage a valve operating device.

In yet another embodiment of the invention, the compression release apparatus employs a single flyweight, a single release shaft, and two lift pins as lift members. The single release shaft is adapted to operate both of the lift pins, even though the lift pins are disposed at different positions along the length of the cam shaft and at different angular positions relative to a longitudinal axis of the cam shaft.

In yet another embodiment of the invention, the compression release apparatus utilizes two lift members engageable with a single shaft, the shaft having two flat surface portions upon which the lift members rest when the apparatus is in the disengaged position.

In yet another embodiment of the invention, the compression release apparatus utilizes a single flat crescent-shaped lift member with two bearing surfaces for engaging valve tappets. Upon rotation of a D-shaped shaft portion, the lift member is pivoted about a pin connection such that the bearing surfaces engage the two valve tappets.

In yet another embodiment of the invention, the compression release apparatus utilizes a single lift member and a single release shaft having a crankpin connected to the lift member. The crankpin causes the lift member to move upon rotation of the release shaft.

In yet another embodiment of the invention, the compression release apparatus utilizes a single flat lift member having two prongs which are positioned on the same plane transverse to the cam shaft. On top of each prong is an extended flat portion having a bearing surface that engages a respective valve tappet.

It is a feature and an advantage of the present invention to provide a centrifugally-responsive compression release apparatus for reducing compression in more than one cylinder of an internal combustion chamber.

It is a feature and an advantage of the present invention to provide a centrifugally-responsive compression release apparatus that acts on more than one valve operating device to hold an exhaust valve open during a particular period in the engine cycle.

It is a feature and an advantage of the present invention to provide a centrifugally-responsive compression release apparatus that is operable to relieve compression in two cylinders of a V-twin engine.

It is a feature and an advantage of the present invention to provide a centrifugally-responsive compression release apparatus that is adaptable to relieve compression in more than two cylinders of an internal combustion engine.

It is a feature and an advantage of the present invention to provide a compression release apparatus that requires a minimum number of parts to operate more than one valve operating device for an internal combustion engine.

It is a feature and an advantage of the present invention to provide a compression release apparatus that employs a single flyweight to change the position of more than one valve operating device in response to engine speed.

It is a feature and an advantage of the present invention to provide a centrifugally-responsive compression release apparatus that employs only three or less moving members to change the position of more than one valve operating device in response to engine speed.

It is a feature and an advantage of the present invention to provide a centrifugally-responsive compression release apparatus that utilizes a single shaft and one or more lift members to change the position of one or more valve operating devices in response to engine speed.

It is a feature and an advantage of the present invention to provide a compression release apparatus for reducing compression in more than one cylinder of an internal combustion chamber that is less expensive and requires fewer machining and assembly operations.

It is a feature and an advantage to of the present invention to provide a compression release apparatus that requires less motion to relieve compression in more than one cylinder of an internal combustion chamber than prior art compression release apparatus.

It is a feature and an advantage of the present invention to provide a compression release apparatus that operates at reduced motion and has a relatively low kickout speed.

These and other features and advantages of the present invention will be apparent to those skilled in the art from the following description of the preferred embodiments, and the drawings, in which:

BRIEF DESCRIPTION OF THE DRAWINGS

FIG. 1 is a perspective view of a first embodiment of a compression release apparatus in accordance with the present invention, the apparatus utilizing a single flyweight, a single release shaft, and a single U-shaped lift member.

FIG. 4 is a sectional view, taken along line 4—4 of FIG. 2, depicting an inboard portion of the release shaft received in apertures in the cam gear and the flyweight.

FIG. 5 depicts a lift member of the first embodiment of the present invention, the lift member being U-shaped and having two prongs.

FIG. 6 is a cross-sectional end view of the first embodiment of FIG. 1, depicting the compression release apparatus in the engaged position.

FIG. 7 is a cross-sectional end view of the first embodiment, depicting the compression release apparatus in the engaged position.

FIG. 13 is a side view of laminated cam lobes used in a third embodiment of the invention.

FIG. 14 is a cross-sectional end view taken along line 14—14 in FIG. 13, depicting a lift member lamination having a raised portion with a bearing surface adapted to engage a valve tappet.

FIG. 15 is a cross-sectional end view of the third embodiment of the invention, depicting the compression release apparatus in the engaged position.

DETAIL DESCRIPTION OF THE INVENTION

Figure 2:
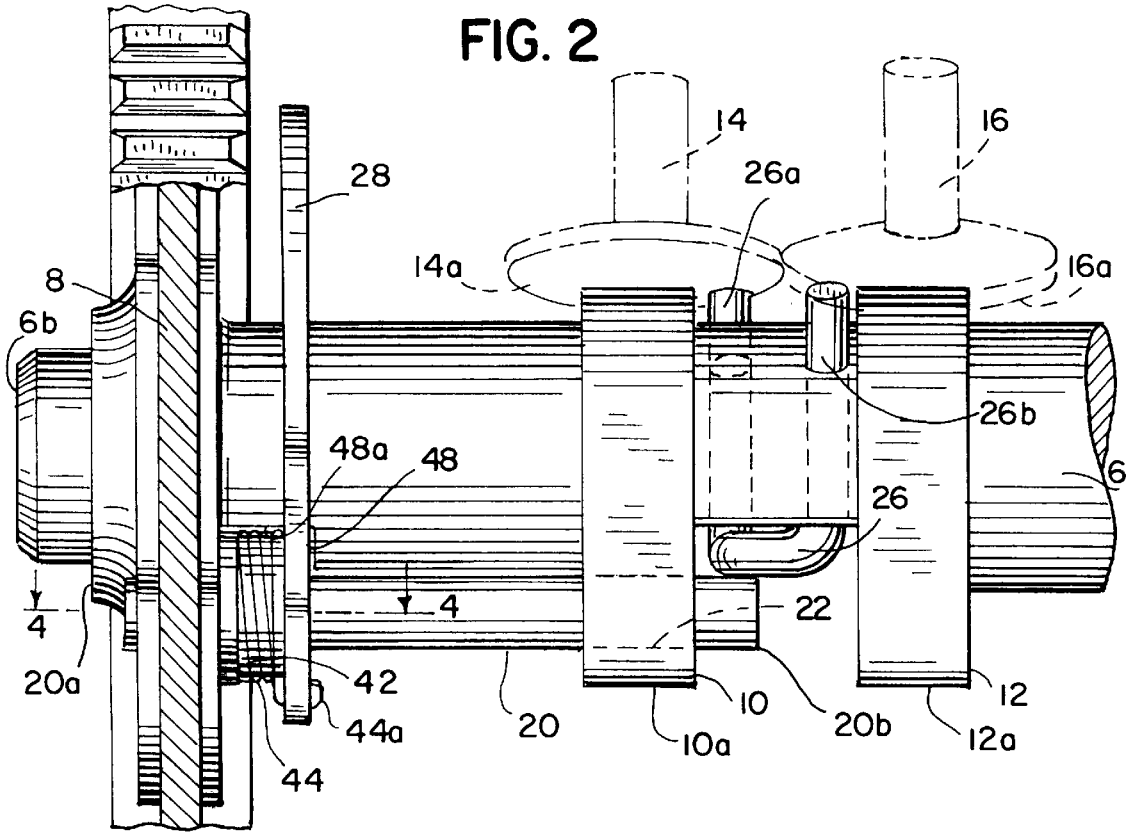
FIG. 2 is a side view of the compression release apparatus, taken along line 2—2 of FIG. 1.

The present invention is directed to a centrifugally-responsive compression release apparatus for reducing compression in more than one cylinder of an internal combustion engine during engine starting. The apparatus is particularly adaptable to reducing compression in the two cylinders of a V-twin engine, although the invention may be adapted to relieve compression in more than two cylinders by extending the release shaft and using one or more additional lift members.

Generally, a compression release apparatus according to the invention will include centrifugally-responsive means, a single release shaft that is operable by the centrifugally responsive means, and at least one lift member movable by the release shaft to change the position of at least two valve operating devices.

Referring to FIG. 1, the compression-release apparatus 2 is positioned next to a rotatable cam shaft 6 that is disposed in an engine housing (not shown) having an outboard end 6*a* and an inboard end 6*b*. Mounted on the inboard end 6*b* of the cam shaft 6 is a cam gear 8. Also mounted on the cam shaft 6 and rotatable therewith are two cam lobes 10,12 (hereinafter referred to as "the inboard cam lobe" 10 and "the outboard cam lobe" 12). Each cam lobe 10,12 has a respective cam 10*a*,12*a* that engages a respective valve operating device (not shown) including respective valve tappets to operate the respective exhaust valves associated with the respective combustion chambers (not shown).

In a first embodiment of the invention depicted in FIGS. 1 through 9, a release shaft 20 is disposed near the outer surface of the cam shaft 6. The release shaft 20 extends from the cam gear 8 and is passed through an aperture 22 in the inboard cam lobe 10. The release shaft 20 has a D-shaped portion 24 that begins on the outboard side of the cam gear 8. The D-shaped shaft portion 24 comprises a flat portion or surface 24*a* having a reduced radial length and a rounded portion or rounded surface 24*b* having a greater radial length. The D-shaped shaft portion 24 is engageable with a U-shaped lift member 26 that has two prongs 26*a*,26*b* which are adapted to lift the two respective valve tappets 14,16 upon rotation of the D-shaped shaft portion 24 (see FIG. 2). The lift member 26 is preferably U-shaped, although other shapes may be used. The U-shaped lift member 26 may be disposed in guideways (e.g., slots, gaps, or apertures) within or around the cam shaft 6, or may be disposed around the outer surface of the cam shaft 6.

At engine starting speeds, the rounded portion 24*b* of the D-shaped shaft portion 24 engages the U-shaped lift member 26 to push the prongs 26*a*,26*b* toward the valve tappets 14,16, thereby lifting the respective associated exhaust valves off their seats (see FIG. 6). As the engine speed is increased, the centrifugally-responsive means, in this case, a flyweight 28, moves away from the cam shaft 6, thereby rotating the release shaft 20 attached thereto so that the flat portion 24*a* of the D-shaped shaft portion 24 is adjacent to the U-shaped lift member 26 (see FIG. 8). As a result, the U-shaped lift member 26 is pushed away by the valve tappets 14,16 during crankshaft rotation, and thus does not affect the seating of the exhaust valves at engine operating speeds.

FIGS. 1, 2 and 6 depict the compression release apparatus 2 in its engaged position at engine starting speeds. As best shown by FIG. 6, in the engaged position, the rounded portion 24*b* of D-shaped shaft portion 24 engages U-shaped lift member 26 such that each of the prongs 26*a*,26*b* of the U-shaped lift member 26 lifts the valve tappets 14,16 a linear distance "X" from the cams 10*a*,10*b*.

Figure 8:
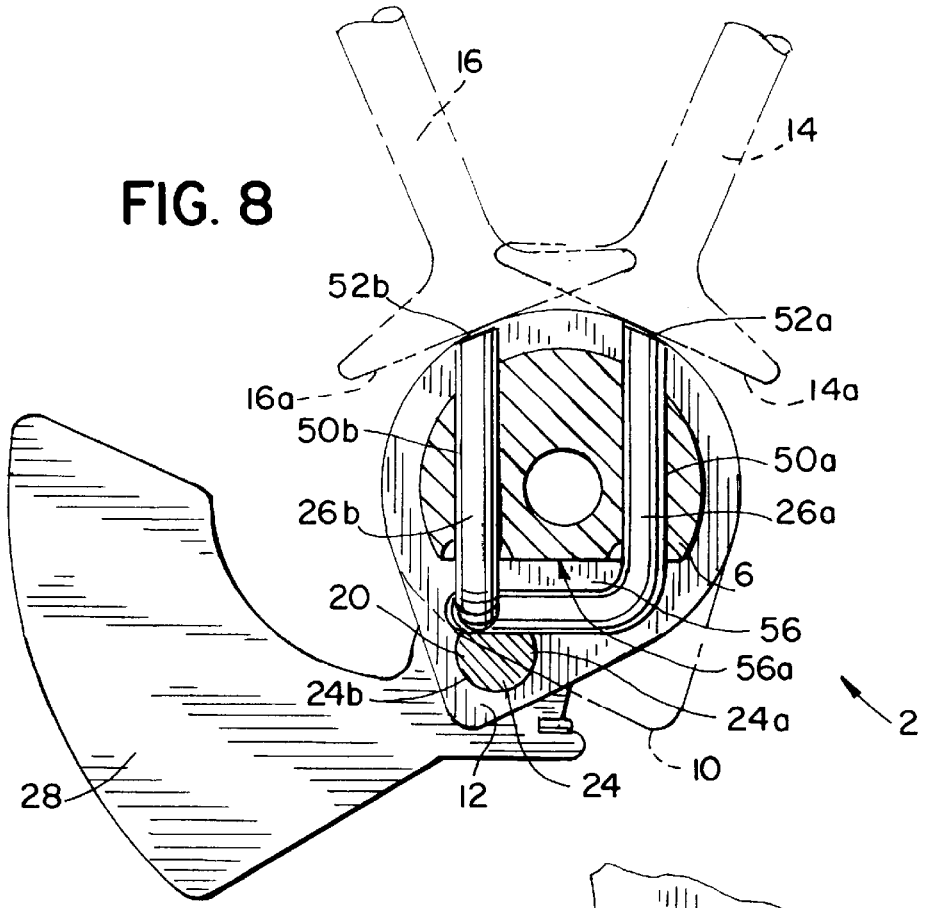
FIG. 8 is a cross-sectional end view of the first embodiment, depicting the compression release apparatus of the first embodiment in the disengaged position.

A compression release apparatus 2 according to the invention is designed to kickout or disengage due to the flyweight 28 moving sufficiently radially outward at engine speeds between 600 rpm and 1200 rpm, although preferably between 650 rpm and 800 rpm. FIG. 8 is a cross-sectional end view of the compression release apparatus 2 at engine running speeds exceeding the kickout speed. The compression release apparatus 2 is in the disengaged position with the flyweight 28 having moved radially outward away from cam shaft 6 and causing the release shaft 20 to be rotated. Here, the U-shaped lift member 26 rests on the flat portion 24*a* of the D-shaped shaft portion 24 and the valve tappets 14,16 are substantially disengaged from the prongs 26*a*,26*b*.

FIG. 4 depicts an inboard end 20*a* of the release shaft 20 received in an aperture 30 in the cam gear 8. Forward of the cam gear 8, the D-shaped portion 24 of release shaft 20 is also received in a flyweight aperture 32 in the flyweight 28. At the flyweight aperture 32, the release shaft 20 has a knurled section 34 that engages and retains a bushing 36. The bushing has a sleeve portion 38 received in the aperture 32 with an inner surface 38*a* that engages the knurled section 34 and with an outer surface 38*b* that engages the flyweight 28. When the flyweight 28 moves radially outward, the flyweight 28 rotates the sleeve portion 38, which in turn rotates the release shaft 20.

Referring to the side view of FIG. 2, the release shaft 20 is also received in the aperture 22 in the inboard cam lobe 10 as well as apertures 30,32 in the cam gear 8 and in the flyweight 28, respectively. The release shaft 20 may be interconnected to the cam shaft 6 at its inboard end 20*a* rather than to the cam gear 8. It will also be apparent to one skilled in the art to adapt the compression release apparatus of the present invention to a differently configured cam shaft.

Figure 3:
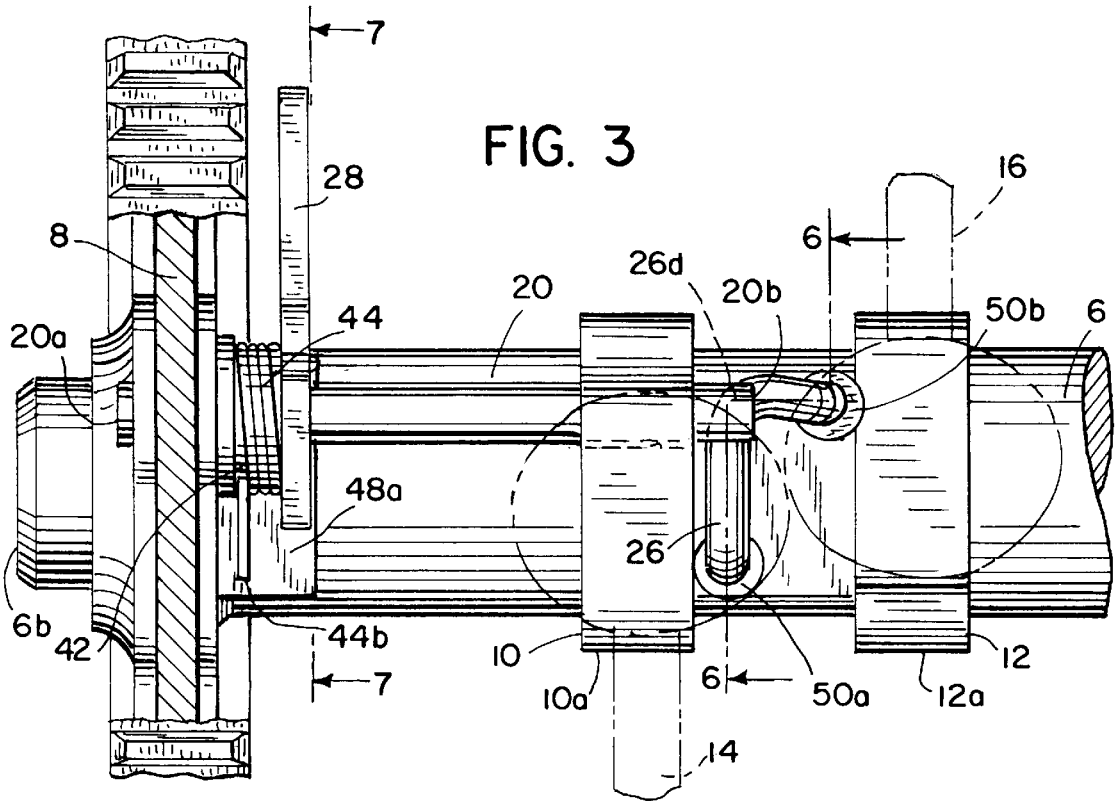
FIG. 3 is a bottom view of the compression release apparatus of FIG. 1.

In FIGS. 2 and 3, the bushing 36 also has a shoulder 42 upon which rests several turns of a torsion spring 44. The spring 44 is biased against the flyweight 28 and provides a means for returning the flyweight 28 from its radially extended position to its rest position adjacent the cam shaft 6 upon a sufficient reduction of engine speed. The spring 44 is disposed around the release shaft 20, between the flyweight 28 and the cam gear 6. A first end 44*a* of the spring 44 is attached to the flyweight 28 (see FIG. 7). A second end 44*b* of the spring 44 rests against a flat surface 48*a* of cam shaft 6 (se FIGS. 3 and 7). In alternative embodiments, the spring may be replaced with counterweights or some other means for returning the flyweight to its rest position.

FIG. 7 is a cross-sectional end view depicting the position of the flyweight 28 at engine starting speeds, i.e., when the compression release apparatus 2 is in the engaged position. In the engaged position, the flyweight 28 of the compression-release apparatus 2 rests adjacent the cam shaft 6. The flyweight 28 has an axially-positioned, nearly oval-shaped flyweight section 46 wherein the flyweight aperture 32 is located and wherein the release shaft 20 is received. Near flyweight 28, the cam shaft 6 has a recess 48 that accommodates the flyweight section 46 and the movement of the flyweight section 46 therein. The recess 48 also allows the release shaft 20 to be brought close to the cam shaft 6 so that it may be passed through the inboard cam lobe 10 to engage the U-shaped lift member 26. Through engagement between the sleeve 38 and the knurled section 34, the flyweight 28 rotates the release shaft 20 when the flyweight 28 is moved radially outward by centrifugal force. In alternative embodiments, the knurled section may not be a full knurl but a knurl having two knobs or other locking means.

In alternative embodiments, the release shaft may have a rounded cross section and the flyweight may have a full or rounded aperture for receiving and driving the rotation of the release shaft. In yet another embodiment, the release shaft may have a rectangular cross-section that engages a flyweight aperture. In yet another embodiment, the flyweight may be directly fixed to the release shaft by set screws or other fastening means.

The flyweight may be formed from a steel stamping or from powdered metal with a nylon bushing. In one particular embodiment, the flyweight and the release shaft is integrally-formed as one piece from a single piece of metal. In a further embodiment, a one-piece flyweight-release shaft configuration is combined with a U-shaped lift member 26 as depicted in FIG. 5, thereby providing a compression release apparatus consisting of two moving components.

Figure 9:
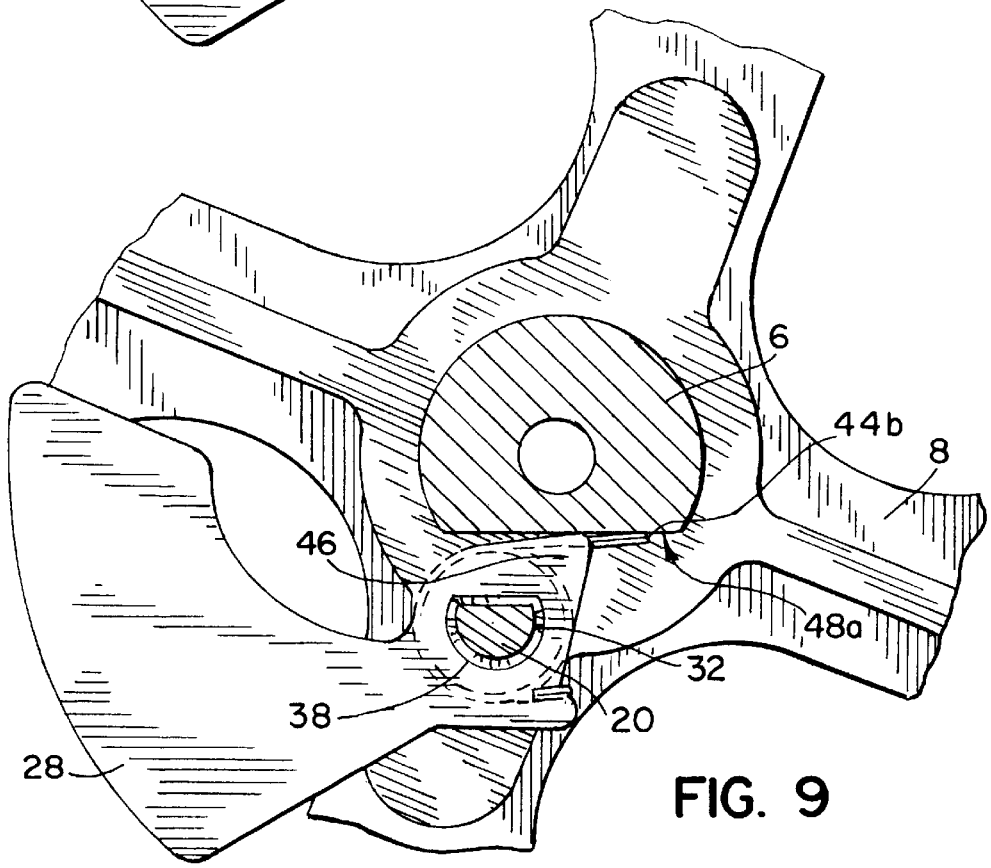
FIG. 9 is a cross-sectional end view of the first embodiment, depicting the compression release apparatus in the disengaged position.

FIG. 9 is a cross-sectional end view depicting the position of the flyweight 28 when the compression release apparatus 2 is in the disengaged position. The flyweight 28 has moved radially outward and is biased against the spring 44. At this position, the flyweight section 46 also engages the recess surface 48*a* of the cam shaft 6 thereby stopping further movement of the flyweight 28.

FIG. 5 depicts just one of several embodiments of the lift member according to the present invention. The lift member 26 is substantially U-shaped and includes a pair of rod-shaped prongs 26*a*,26*b* joined by a bridge portion 26*c*. A first prong 26*a* is associated with the inboard cam lobe 10 and a first valve tappet 14 (see also FIG. 2). A second prong

26*b* is associated with the outboard cam lobe 12 and a second valve tappet 16 (see also FIG. 2). The U-shaped member may be made of soft steel or pre-hardened "music wire." One source for the pre-hardened music wire is Rockford Spring of Rockford, Ill.

Referring to FIGS. 5 and 6, the prongs 26*a,*26*b* are each received in guideways or apertures 50*a,*50*b* bored through the cam shaft 6. Each of the prongs 26*a,*26*b* has a bearing surface 52*a,*52*b* that is adapted to engage a bottom surface 14*a,*14*b* of a valve tappet 14,16. Each bearing surface 52*a,*52*b* is a planar surface that corresponds to the orientation of the bottom surfaces 14*a,*14*b* of the valve tappets 14,16 when engaged with the bearing surfaces 52*a,*52*b*. During rotation of the release shaft 20 (caused by movement of the flyweight 28), the prongs 26*a,*26*b* travel within the apertures 50*a,*50*b* to engage and disengage the valve tappets 14,16. In alternative embodiments, each bearing surface may be dome-shaped or may be radiused so as to define a curved surface in the end view of FIG. 6. In alternative embodiments, the apertures 50*a,*50*b* may be replaced with a slot or cutout in the cam shaft to receive the prongs, or, the prongs may be configured to go around the cam shaft to position the bearing surfaces to engage the valve tappets. Note also in FIG. 6 that the apertures 50*a,*50*b* have been positioned in the cam shaft 6 so as to clear an oil port 54 that is in the center of the cam shaft 6.

Referring to the side view of FIG. 2, the prongs 26*a,*26*b* are positioned along the length of the cam shaft 6 between the cam lobes 10,12 such that the bearing surfaces 52*a,*52*b* engage the bottom surfaces 14*a,*16*a* of the valve tappets. Referring to the cross-sectional end view of FIG. 6, the prongs 26*a,*26*b* and the apertures 50*a,*50*b* in the cam shaft 6 are also positioned such that the bearing surfaces 52*a,*52*b* engage the valve tappets 14,16. To accommodate this positioning, the bridge portion 26*c* has a plurality of bends and extensions for navigating around the outer surface of the cam shaft 6 between the inboard cam lobe 10 and the outboard cam lobe 12. Referring to the bottom view of FIG. 3 and the cross-sectional end view of FIG. 6, the bridge portion 26*c* functions to align each prong 26*a,*26*b* with one of the apertures 50*a,*50*b* and with one of the valve tappets 14,16. Note also that the U-shaped lift member 26 is positioned substantially adjacent to the outer surface of the cam shaft 6.

Referring to FIGS. 2 and 3, the outboard end 20*b* of the release shaft 20 is received in an aperture 22 in the inboard cam lobe 12 and extends past the inboard cam lobe 12 to engage the U-shaped lift member 26 near an intermediate bend 26*d* of the bridge portion 26*c*. In between the cam lobes 10,12, the cam shaft 6 has been modified with a recess 56 so as to accommodate the bridge portion 26*c* of the U-shaped lift member 26. In the engaged position depicted in FIG. 6, the bridge portion 26*c* almost engages the recess surface 56*a* of the cam shaft 6 when it is raised by the rounded portion 24*b* of the D-shaped shaft portion 24. The D-shaped shaft portion 24 begins on the outboard side of cam gear 8.

Figure 10:
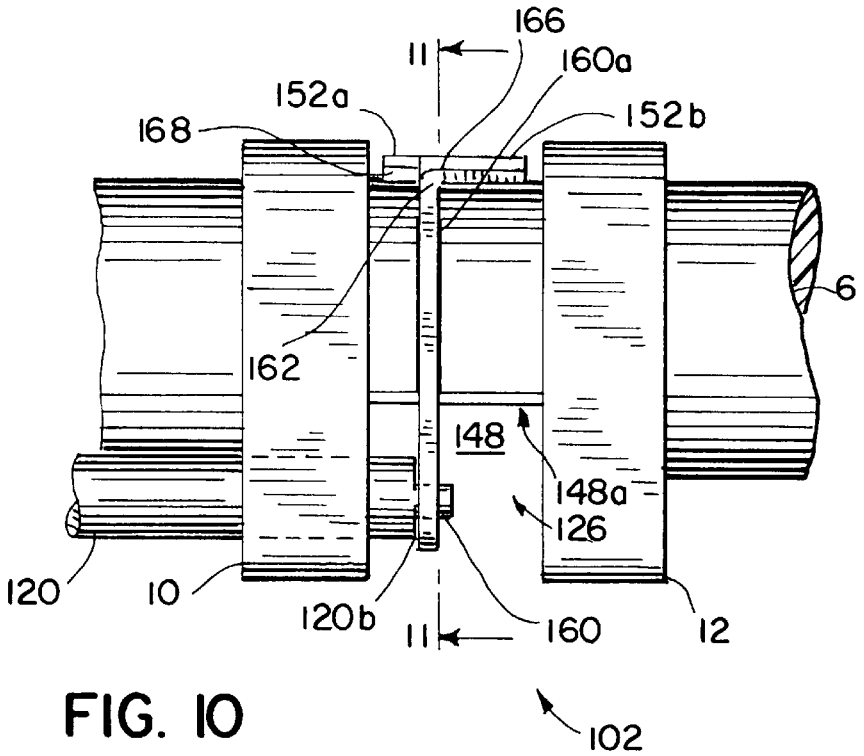
FIG. 10 is a side view of a portion of a second embodiment of the invention disposed between the two cam lobes, wherein the compression release apparatus is in the disengaged position.
Figure 11:
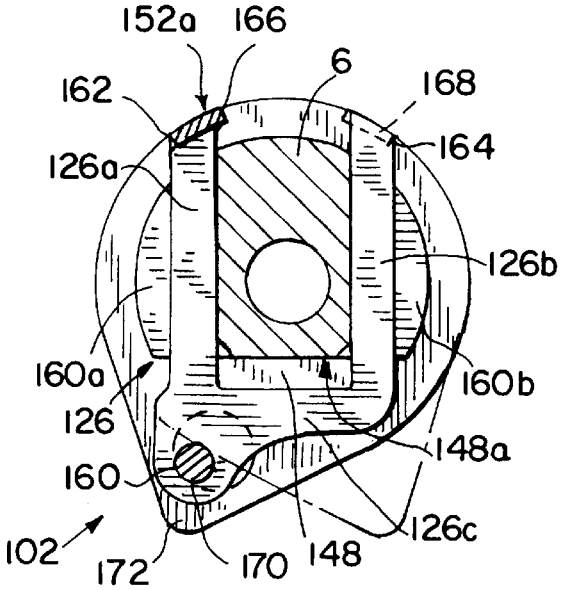
FIG. 11 is a cross-sectional view through line 11—11 of FIG. 10, depicting the two prongs positioned around the cam shaft.
Figure 12:
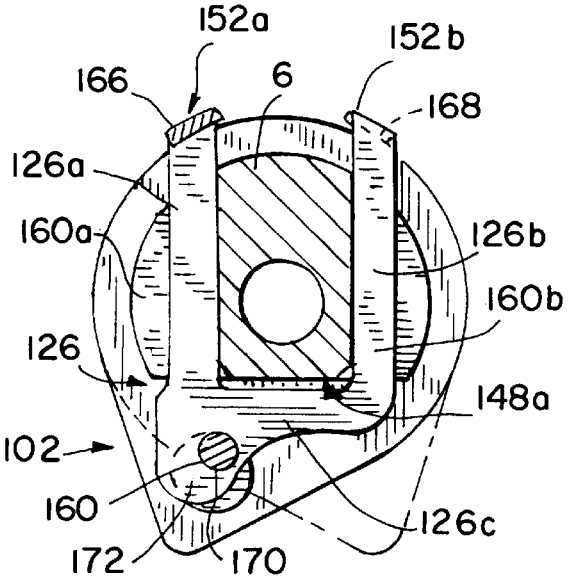
FIG. 12 is a cross-sectional end view of a second embodiment of the present invention, depicting the two-pronged lift member and the crankpin in the engaged position.

FIGS. 10 through 12 depict a second embodiment of the invention wherein the compression release apparatus 102 utilizes a single U-shaped lift member 126 having two prongs 126*a,*126*b* and a release shaft 120 having a crankpin 160 for moving the lift member 126 in response to engine speed. The U-shaped lift member 126 also has a bridge portion 126*c* that joins the two prongs 126*a,*126*b*. In this embodiment, however, the prongs 126*a,*126*b* are both positioned on a common plane substantially transverse to the longitudinal axis of the cam shaft 6. Therefore, the bridge portion 126*c* does not need a plurality of bends as in the first embodiment. Instead, the bridge portion 126*c* merely extends across the cam shaft 6 to join the two prongs 126*a,*126*b*. The prongs 126*a,*126*b* of the second embodiment are slat-shaped and are received in guideways or slots 160*a,*160*b* in the cam shaft 6. Note however that the prongs may be rod-shaped as in the first embodiment and received in apertures in the cam shaft.

Referring to FIGS. 11 and 12, each prong 126*a,*126*b* has a top bend 162,164 that forms an extended bearing surface portion 166,168. Each bearing surface portion 166,168 extends towards one of the cam lobes 10,12 and to a position beneath a valve tappet. When the apparatus 102 is in the engaged position, a bearing surface 152*a,*152*b* of each extended bearing surface portion 166,168 engages the bottom surface of a valve tappet to lift the valve tappet. In further embodiments, the prongs will be positioned on other points along the length of the cam shaft 6 between the cam lobes 10,12. In these embodiments, one or both of the bearing surface portions may be extended to compensate for the linear distance between the valve tappets.

In yet another embodiment of the U-shaped lift member, the lift member is made from three separate pieces—two pins with top bearing surfaces and a stamped bridge portion engageable with a D-shaped shaft portion. The two pins are press fit or otherwise attached to the stamped bridge portion and are equipped with bearing surfaces. In this embodiment, the two pins do not lie on the same plane substantially transverse to the longitudinal axis of the cam shaft. To join the two pins, the bridge portion extends across the diameter and length of the cam shaft.

Another feature of the second embodiment is a crankpin 160 on the outboard end 120*b* of the release shaft 120 (See FIGS. 11 and 12). The crankpin 160 is received in an aperture 170 on an outer section 172 of the lift member 172 below the bridge portion 126*c*. Upon rotation of the release shaft 120, the U-shaped lift member 126 is moved by the crankpin 160 a linear distance so that the bearing surfaces 152*a,*152*b* engage and lift the valve tappets. In yet another embodiment, the crankpin of the second embodiment may be replaced with a D-shaped portion similar to that used in the first embodiment.

FIGS. 11 and 12 depict the U-shaped lift member 126 and the crankpin 160 in the engaged position and the disengaged position respectively. The cross-sectional end view of FIG. 11 depicts the two prongs 126*a,*126*b* positioned around the cam shaft 6 and the bridge portion 126*c* beneath a recess 148 in the cam shaft 6. FIG. 12 depicts the lift member 126 and the crankpin 160 in the engaged position. The crankpin 160 has moved the two prongs 126*a,*126*b* a linear distance to engage the valve tappets such that the bridge portion 126*c* is closer to the recess surface 148*a* of the cam shaft 6.

FIGS. 13 through 15 depict a third compression release apparatus 202 embodying the invention. In this embodiment, the apparatus 202 utilizes a single release shaft 220 to operate two separate lift members 226,227 in an engine wherein the cam lobes 210,212 are formed from a series of stamped concentric laminations. Each of the lift members 226,227 is a single lamination movably disposed between the stamped laminations of the cam lobes 210,212. The release shaft 220 is disposed along a longitudinal axis centered between the two cam lobes 210,212 (see FIGS. 14 and 15) so that the release shaft 220 may be received in apertures 240,241 in each cam lobe 210, 212, as depicted in FIG. 13. Another feature is that the release shaft 220 has two separate D-shaped shaft portions 224,225, each engageable with one of the lift member laminations 226,227. One D-shaped shaft portion 224 is disposed in the aperture 240 of the inboard cam lobe 210 and the other D-shaped shaft portion 225 is disposed in the aperture 241 of the outboard cam lobe 212.

Each of the lift member laminations 226,227 is free to move up and down between the laminations of the cam lobes 210,212 restricted only by the cam shaft 6 and the D-shaped shaft portion 224,225. As depicted in FIG. 15, each lift member lamination 226,227 has a raised outer portion 260,262 with a bearing surface 252*a*,252*b* adapted to engage the bottom surface of a valve tappet. Each lift member lamination 226,227 also has an open center section 264 for providing clearance around the cam shaft 6. As shown in FIG. 13, where the apparatus 202 is in the disengaged position, and in FIG. 14, where the apparatus 202 is in the engaged position, the open section 264 accommodates for the movement of the lift member lamination 226,227 due to rotation of the D-shaped shaft portion 224,225. Each lift member lamination 226,227 also has a lower cutout 266 for receiving and engaging the D-shaped shaft portion 224,225.

Figure 16:
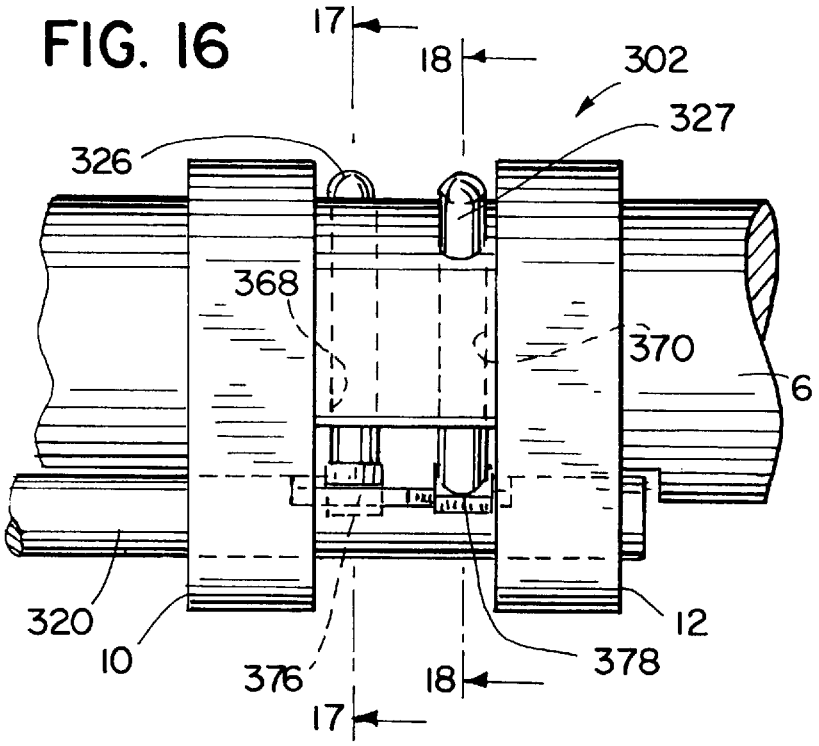
FIG. 16 is side view of a cam lobe portion of a fourth embodiment of the invention, wherein the compression release apparatus utilizes two lift pins received in apertures bored through the cam shaft.
Figure 17:
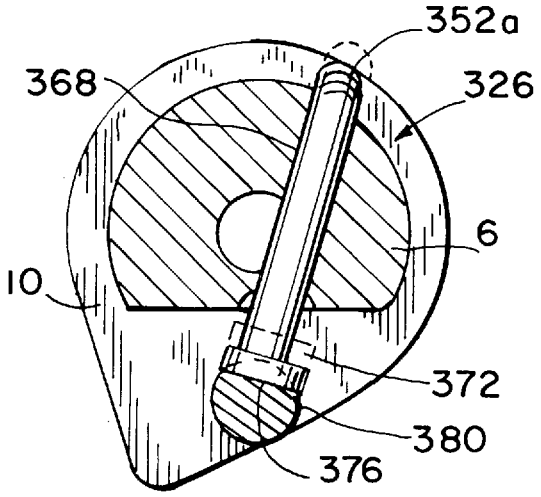
FIG. 17 is a cross-sectional end view through line 17—17 of FIG. 16, depicting the compression release apparatus in the disengaged position.
Figure 18:
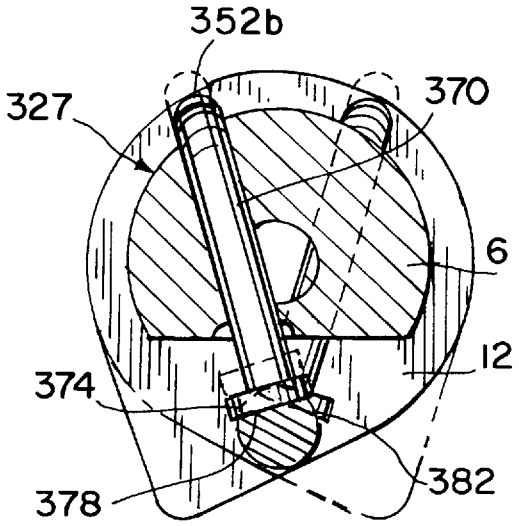
FIG. 18 is a cross-sectional end view through line 18—18 of FIG. 16, depicting a second lift pin having a base resting on a second flat portion of the release shaft.

FIGS. 16 through 18 depict yet another compression release apparatus 302 embodying the invention. In this fourth embodiment of the invention, the apparatus 302 again utilizes a single release shaft 320 to operate two separate lift members 326,327. The release shaft 320 is centered between the two cam lobes 10,12 and extends through the outboard cam lobe 12 as well as the inboard cam lobe 10. The lift members 326,327 are lift pins 326,327 which are received in guideways or apertures 368,370 bored through the cam shaft 6. In this embodiment, bearing surfaces 352*a*,352*b* disposed on top of each lift pin 326,327 have a dome shape. Note, however, that any of the planar bearing surfaces disclosed in previous embodiments are adaptable for use with the lift pins 326,327 of this embodiment.

Each of the lift pins also has an enlarged base 372,374 for engaging the release shaft 320. Another feature of this embodiment is that the release shaft 320 is equipped with two flat portions 376,378 upon which the enlarged bases 372,374 rest when the apparatus 302 is in the disengaged position. The flat portions 376,378 are not coplanar but are each generally normal to the axes of the apertures 368,370 wherein the lift pins 326,327 travel. In the cross-sectional end view of FIG. 17, where the compression release apparatus 302 is in the disengaged position, the enlarged base 372 of the inboard lift pin 326 rests on a first flat portion 376 of the release shaft 320. In the cross-sectional end view of FIG. 18, the enlarged base 374 of the outboard lift pin 327 rests on a second flat portion 378 of the release shaft 320. When the apparatus 302 is in the engaged position, the enlarged bases 372,374 engage two different ridges or rounded portions 380,382 of the release shaft 320. In an alternative embodiment, one or both of the enlarged bases may be reshaped such that both enlarged bases have a bottom surface that is coplanar with a bottom surface on the other. In such an embodiment, both bottom surfaces would be engageable with only one flat portion to the shaft, the flat portion extending between the two bases.

In FIGS. 16 through 18, the release shaft 320 is depicted as extending through the outboard cam lobe 12. It will also be clear from FIG. 16 that the release shaft 320 does not have to extend through the outboard cam lobe 12 but may be terminated at the point below the outboard lift pin 327. However, in some engines, the arrangement depicted in FIG. 16 may promote greater stability and precision in the compression release apparatus 302.

Figure 19:
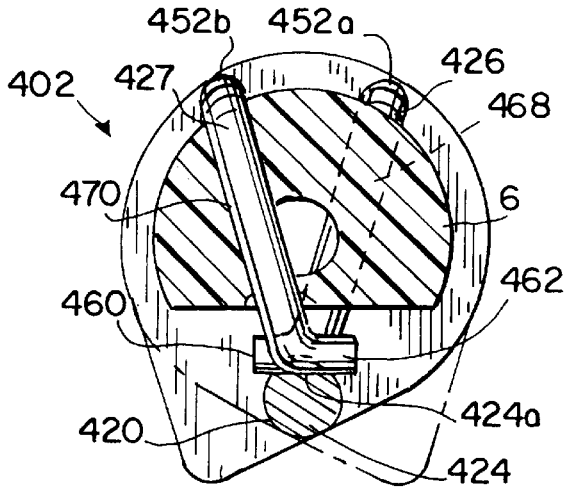
FIG. 19 is a cross-sectional end view of a fifth embodiment of the invention, wherein the compression release apparatus utilizes two lift pins.
Figure 20:
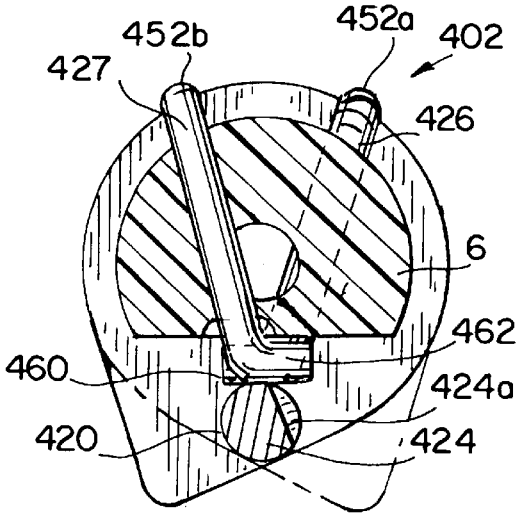
FIG. 20 is a cross-sectional end view of the fifth embodiment of the invention, depicting the compression release apparatus in the engaged position.

FIGS. 19 and 20 is yet a fifth compression release 402 apparatus embodying the invention. In this fifth embodiment, the compression release apparatus 402 utilizes a single release shaft 420 with a D-shaped shaft portion 424 to operate two lift pins 426,427. Each of the two lift pins 426,427 is equipped with a footer 460,462 which extend towards the centrally positioned D-shaped shaft portion 424. As in the fourth embodiment of the invention, the lift pins 426,427 in this embodiment are received in guideways or apertures 468,470 bored through the cam shaft 6 and have dome-shaped bearing surfaces 452*a*,452*b*. Unlike in the fourth embodiment, however, the D-shaped shaft portion 424 has a single flat portion 424*a* upon which the extended footers 460,462 rest when the compression release apparatus 402 is in the disengaged position (see FIG. 19). FIG. 20 depicts the position of the two lift pins 426,427 and the D-shaped shaft portion 424 when the compression release apparatus 402 is in the engaged position.

Figure 21:
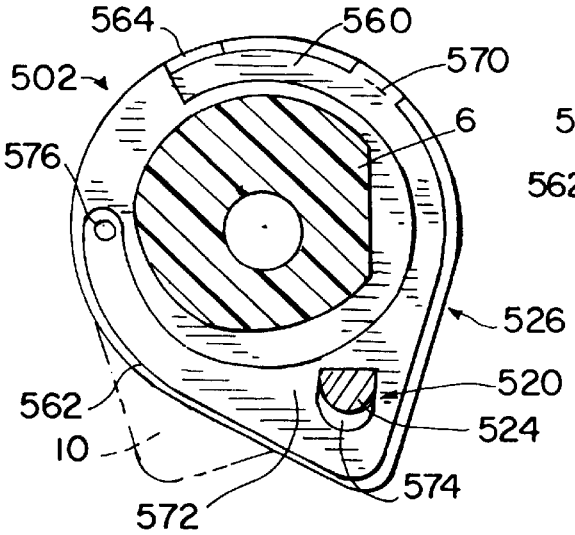
FIG. 21 is a cross-sectional end view of a sixth embodiment of the invention.
Figure 22:
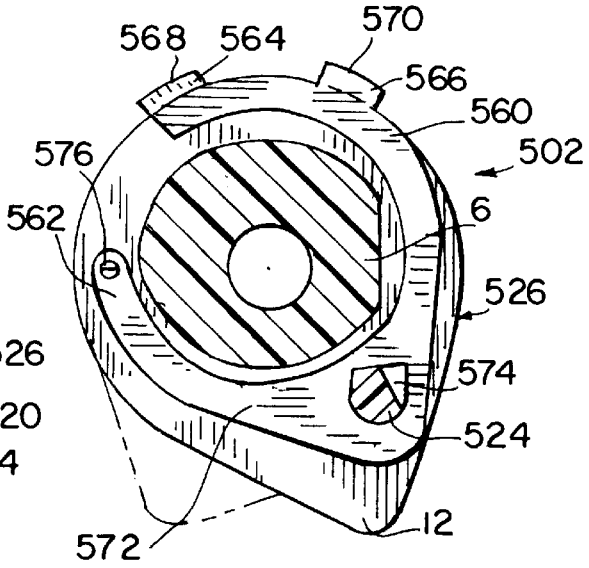
FIG. 22 is a cross-sectional end view of the sixth embodiment of the invention, depicting the compression release apparatus in the engaged position.

FIGS. 21 and 22 depicts a sixth compression release apparatus 502 embodying the invention. The apparatus 502 of this embodiment utilizes a single release 520 shaft having a D-shaped shaft portion 524 and a single flat, crescent-shaped lift member 526 positioned between the two cam lobes 10,12. On a first arc segment 560, the crescent-shaped lift member 526 has a pair of raised portions 564,566 with extended bearing surfaces 568,570 for engaging the valve tappets. The crescent-shaped lift member 526 also has a center section 572 that is shaped to provide clearance around the cam shaft 6. The center section 572 provides an aperture 574 for receiving and engaging the D-shaped shaft portion 524. The crescent-shaped lift member 526 further includes a second arc segment 562 that is equipped with a pivot pin 576. When the D-shaped portion 524 is rotated, the lift member 526 pivots about the pivot pin 576 to move the raised portions 564,566 outward such that the bearing surfaces 568,570 engage the valve tappets (see FIG. 22). Note in FIGS. 21 and 22 the clearance between the cam shaft and the crescent-shaped lift member 526 in the two positions of the compression-release apparatus 502.

While several embodiments of the present invention have been shown and shown described, alternate embodiments will be apparent to those skilled in the art and are within the intended scope of the present invention. Therefore, the invention is to be limited only by the following claims.

I claim:

1. A compression release apparatus for reducing compression in a plurality of combustion chambers in an engine, the engine having a cam shaft with a plurality of cam lobes, a first valve operating device engageable with a first cam lobe associated with a first combustion chamber, and a second valve operating device engageable with a second cam lobe associated with a second combustion chamber, said apparatus comprising:

a single lift member engageable with both the first and second valve operating devices; and centrifugally-responsive means for changing the position of said single lift member in response to engine speed.

2. The compression release apparatus of claim 1, wherein said centrifugally responsive means includes a flyweight.

3. The compression release apparatus of claim 1, wherein said single lift member is adapted to being disposed substantially adjacent to an outer surface of the cam shaft.

4. The compression release apparatus of claim 1, wherein said single lift member is at least partially received within a guideway in the cam shaft.

5. The compression release apparatus of claim 1, wherein the first and second valve operating devices are disposed at two distinct angular positions relative to a longitudinal axis of the cam shaft, said single lift member having a first portion that is engageable with the first valve operating device and a second portion that is engageable with the second valve operating device.

6. A compression release apparatus for reducing compression in a plurality of combustion chambers in an engine, the engine having a cam shaft with a plurality of cam lobes and at least two valve operating devices, each valve operating device being associated with a distinct one of the plurality of combustion chambers, said apparatus comprising:

a single lift member engageable with said two valve operating devices;

a flyweight; and a single shaft operable by said flyweight to change the position of said lift member in response to engine speed, said single shaft being positioned substantially outside of the cam shaft.

7. A compression release apparatus for reducing compression in a plurality of combustion chambers in an engine, the engine having a cam shaft with a plurality of cam lobes, a first valve operating device associated with a first combustion chamber, and a second valve operating device associated with a second combustion chamber, said apparatus comprising:

a single lift member engageable with both the first and second valve operating devices;

centrifugally-responsive means for changing the position of said single lift member in response to engine speed; and a single shaft engageable with said single lift member and operable by said centrifugally-responsive means to change the position of said single lift member in response to engine speed.

8. The compression release apparatus of claim 7, wherein said single shaft extends substantially through at least one of the cam lobes, and said single lift member is disposed substantially in between two of the cam lobes.

9. The compression release apparatus of claim 7, wherein said centrifugally responsive means includes a flyweight, and wherein said compression release apparatus further comprises:

a single shaft engageable with said single lift member and operable by said centrifugally-responsive means to change the position of said single lift member in response to engine speed, said single shaft being integrally formed as one piece with said flyweight.

10. A compression release apparatus for reducing compression in a plurality of combustion chambers in an engine, the engine having a cam shaft with a plurality of cam lobes, a first valve operating device associated with a first combustion chamber, and a second valve operating device associated with a second combustion chamber, said apparatus comprising:

a single lift member engageable with both the first and second valve operating devices wherein said single lift member has a first prong and a second prong, said first prong being movably received within a first guideway in the cam shaft to engage one of the valve operating devices and said second prong being partially received within a second guideway in the cam shaft to engage a second valve operating device; and centrifugally-responsive means for changing the position of said single lift member in response to engine speed.

11. A compression release apparatus for reducing compression in a plurality of combustion chambers in an engine, the engine having a cam shaft with a plurality of cam lobes and at least two valve operating devices, each valve operating device being associated with a distinct one of the plurality of combustion chambers, said apparatus comprising:

at least one lift member engageable with first and second valve operating devices and having a shape that substantially conforms to an outer surface of the cam shaft;

a flyweight; and a single shaft operable by said flyweight to change the position of said at least one lift member in response to engine speed, said single shaft being positioned substantially outside of the cam shaft.

12. The compression release apparatus of claim 11, wherein said at least one lift member includes a first prong for engaging the first valve operating device and a second prong for engaging the second valve operating device.

13. The compression release apparatus of claim 12, wherein each of said first and second prongs is at least partially received in a guideway in the cam shaft.

14. A compression release apparatus for reducing compression in a plurality of combustion chambers in an engine, the engine having a cam shaft with a plurality of cam lobes and at least two valve operating devices, each valve operating device being associated with a distinct one of the plurality of combustion chambers, said apparatus comprising:

at least one lift member engageable with at least one valve operating device;

a flyweight;

a single shaft operable by said flyweight to change the position of said at least one lift member in response to engine speed, said single shaft being positioned substantially outside of the cam shaft; and wherein said single shaft extends substantially through at least one of the cam lobes, and said at least one lift member is disposed substantially in between two of the cam lobes.

15. A compression release apparatus for reducing compression in a plurality of combustion chambers in an engine, the engine having a cam shaft with a plurality of cam lobes, a first valve operating device engageable with a first cam lobe associated with a first combustion chamber, and a second valve operating device engageable with a second lobe associated with a second combustion chamber, said apparatus comprising:

a single lift member, integrally formed as one piece, engageable with both the first and second valve operating devices; and centrifugally-responsive means for changing the position of said single lift member in response to engine speed.

* * * * *